US006663039B2

(12) United States Patent
Hoffmann et al.

(10) Patent No.: US 6,663,039 B2
(45) Date of Patent: Dec. 16, 2003

(54) PROCESS FOR MANUFACTURING AN ELECTRICAL-POWER TRANSFORMER HAVING PHASE WINDINGS FORMED FROM INSULATED CONDUCTIVE CABLING

(75) Inventors: Roland Hoffmann, Brilon (DE); Thomas J. Lanoue, Cary, NC (US); Benjamin Weber, Winterberg (DE)

(73) Assignee: ABB Technology AG, Zurich (CH)

( * ) Notice: Subject to any disclaimer, the term of this patent is extended or adjusted under 35 U.S.C. 154(b) by 29 days.

(21) Appl. No.: 10/126,121

(22) Filed: Apr. 19, 2002

(65) Prior Publication Data

US 2003/0006334 A1 Jan. 9, 2003

(30) Foreign Application Priority Data

Jul. 5, 2001 (DE) ..... 101 32 718

(51) Int. Cl.[7] ..... H01F 41/08

(52) U.S. Cl. ..... 242/434.5; 242/441.1; 29/605

(58) Field of Search ..... 242/434.5, 441.1; 29/605

(56) References Cited

U.S. PATENT DOCUMENTS

| | | | | |
|---|---|---|---|---|
| 243,844 A | | 7/1881 | Brady | |
| 1,603,801 A | | 10/1926 | Potter | |
| 2,305,999 A | | 12/1942 | Steinmayer et al. | 242/4 |
| 2,313,306 A | | 3/1943 | Wiegand | 175/356 |
| 2,516,734 A | | 7/1950 | van den Berge et al. | 242/4 |
| 3,128,955 A | | 4/1964 | Stütz | 242/4 |
| 3,174,699 A | | 3/1965 | Sciaky | 242/9 |
| 3,195,820 A | | 7/1965 | Halacsy | 242/4 |
| 3,766,641 A | | 10/1973 | Metzler et al. | 29/605 |
| 4,325,045 A | | 4/1982 | Mehl | 336/197 |
| 4,422,061 A | * | 12/1983 | Yamamoto et al. | 336/218 |
| 4,480,377 A | * | 11/1984 | House et al. | 29/593 |
| 4,564,998 A | | 1/1986 | Perschka et al. | 29/605 |
| 4,592,133 A | | 6/1986 | Grimes et al. | 29/605 |
| 4,625,927 A | | 12/1986 | Arnold | 242/4 |
| 4,638,554 A | * | 1/1987 | Beisser | 29/605 |
| 5,073,766 A | * | 12/1991 | Hays | 336/217 |
| 5,086,983 A | | 2/1992 | Darrieux | 242/4 |
| 5,515,597 A | | 5/1996 | Herbst et al. | 29/605 |
| 6,100,783 A | * | 8/2000 | Hopkinson et al. | 336/216 |
| 2002/0084879 A1 | * | 7/2002 | Weber et al. | 336/200 |

FOREIGN PATENT DOCUMENTS

WO WO 97/45847 12/1997

OTHER PUBLICATIONS

U.S. patent application Ser. No. 09/541,523, Lanoue et al., filed Apr. 3, 2000.

* cited by examiner

*Primary Examiner*—Kathy Matecki
*Assistant Examiner*—Evan H Langdon
(74) *Attorney, Agent, or Firm*—Woodcock Washburn LLP

(57) ABSTRACT

A presently-preferred process for manufacturing a magnetic-induction device comprises stacking a plurality of laminae to form a winding leg, a first yoke, and a second yoke, and fixedly coupling a first end of the winding leg to the first yoke. The presently-preferred process also comprises winding a length of insulated conductive cabling on the winding leg to form a phase winding after fixedly coupling the winding leg to the first yoke, and fixedly coupling a second end of the winding leg to the second yoke after forming the phase winding. Alternatively, the length of insulated conductive cabling may be wound on the winding leg after the second end of the winding leg has been fixedly coupled to the second yoke.

24 Claims, 6 Drawing Sheets

PROCESS FOR MANUFACTURING AN ELECTRICAL-POWER TRANSFORMER HAVING PHASE WINDINGS FORMED FROM INSULATED CONDUCTIVE CABLING

CROSS-REFERENCE TO RELATED APPLICATION

This application claims benefit of German application DE 101 32 718.8, filed Jul. 5, 2001 in Germany.

1. Field of the Invention

The present invention relates to magnetic-induction devices such as electrical-power transformers. More specifically, the invention relates to the manufacture of an electrical-power transformer having phase windings formed from insulated conductive cabling.

2. Background of the Invention

Electrical-power transformers are used extensively in electrical and electronic applications. Transformers transfer electric energy from one circuit to another circuit through magnetic induction. Transformers are utilized to step electrical voltages up or down, to couple signal energy from one stage to another, and to match the impedances of interconnected electrical or electronic components. Transformers are also used to sense current, and to power electronic trip units for circuit interrupters. Transformers may also be employed in solenoid-equipped magnetic circuits, and in electric motors. The term "distribution transformer" is used to describe electrical-power transformers having power ratings of approximately 50 kVA to approximately 2,000 kVA; distribution transformers typically have high-voltage windings rated at approximately 10 kV to approximately 20 kV.

A typical electrical-power transformer includes two or more multi-turned coils of wire commonly referred to as "phase windings." The phase windings are placed in close proximity so that the magnetic fields generated by the windings are coupled when the transformer is energized. Most electrical-power transformers have a primary winding and a secondary winding. The output voltage of a transformer can be increased or decreased by varying the number of turns in the primary winding in relation to the number of turns in the secondary winding.

The magnetic field generated by the current passing through the primary winding is typically concentrated by winding the primary and secondary windings on a core of magnetic material. More particularly, the primary and secondary windings are placed on one or more winding legs of the core. This arrangement increases the level of induction in the primary and secondary windings so that the windings can be formed from a smaller number of turns while still maintaining a given level of magnetic-flux. In addition, the use of a magnetic core having a continuous magnetic path ensures that virtually all of the magnetic field established by the current in the primary winding is induced in the secondary winding.

An alternating current flows through the primary winding when an alternating voltage is applied to the winding. The value of this current is limited by the level of induction in the winding. The current produces an alternating magnetomotive force that, in turn, creates an alternating magnetic flux. The magnetic flux is constrained within the core of the transformer and induces a voltage across the secondary winding. This voltage produces an alternating current when the secondary winding is connected to an electrical load. The load current in the secondary winding produces its own magnetomotive force that, in turn, creates a further alternating flux that is magnetically coupled to the primary winding. A load current then flows in the primary winding. This current is of sufficient magnitude to balance the magnetomotive force produced by the secondary load current. Thus, the primary winding carries both magnetizing and load currents, the secondary winding carries a load current, and the core carries only the flux produced by the magnetizing current.

FIG. 1 depicts a three-phase distribution transformer 100 of conventional design. The transformer 100 comprises a magnetic core 101. The magnetic core 101 comprises a first winding leg 102, a second winding leg 104, and a third winding leg 106. The transformer 100 also comprises an upper yoke 108 and a lower yoke 110. The winding legs 102, 104, 106 and the upper and lower yokes 108, 110 each comprise a plurality of laminae 120 formed from a suitable magnetic material such as textured silicon steel or an amorphous alloy. The winding legs 102, 104, 106 and the upper and lower yokes 108, 110 are each formed by stacking (superposing) a respective set of laminae 120 to a predetermined depth and binding the laminae 120 using a suitable means such as adhesive.

Opposing ends of the winding legs 102, 104, 106 are fixedly coupled to the upper and lower yokes 108, 110 using a suitable means such as adhesive. A cylindrical phase winding 112 is positioned on each of the winding legs 102, 104, 106. Each phase winding 112 comprises a low-voltage primary winding 112*a* and a concentric, high-voltage secondary winding 112*b* located radially outward of the primary winding 112*a*. The primary and secondary windings 112*a*, 112*b* are each formed by multiple layers, or coils, of conductive cabling connected in series. Each layer is formed by a plurality of turns of the conductive cabling connected in series.

The conductive cabling used to form the phase windings 112 is typically non-insulated cabling. The use of non-insulated cabling necessitates the placement of an electrically-insulative material within the phase windings 112. More particularly, a solid, electrically-insulative material such as epoxy resin is typically placed between adjacent turns, and between adjacent layers within the phase winding 112. (The phase windings of oil-filled transformers are further insulated by the mineral oil that surrounds the phase windings within such transformers.)

The placement of insulation between the adjacent turns and layers of the phase winding 112 is necessary to prevent short-circuiting that would otherwise occur due to the differing electric potential between the adjacent layers and turns. Insulation is also necessary to prevent short circuiting between adjacent phase windings 112, and between the phase windings 112 and adjacent conductive components. The solid insulative material is placed individually over each cable layer, and between adjacent turns in the particular layer, immediately after the layer has been wound. Hence, installation of the solid insulative material must be integrated into the winding process for each phase winding 112.

The phase winding 112 can alternatively be formed from insulated conductive cabling (as shown in FIG. 1). For example, PCT application serial no. PCT/SE/9700875 (international publication no. WO 97/45847) discloses a transformer winding formed from an insulated conductive cable having an inner conductor surrounded by a concentric layer of semi-conductor material. The layer of semi-conductor material is surrounded by a concentric layer of solid insulative material. The layer of solid insulative material is surrounded by a concentric second layer of semiconductor material that forms the outermost portion of the cable. Forming a phase winding from insulated conductive cabling eliminates the need to install additional solid insulative material within the phase winding as the phase winding is wound. Another example of insulated conductive cabling suitable for use in forming the phase winding 112 is disclosed in pending U.S. patent application Ser. No. 09/541,523, filed Apr. 3, 2000, which is incorporated herein by reference in its entirety.

The transformer 100 may be manufactured in accordance with the following conventional process. The phase windings 112 are formed using a suitable mandrel. More particularly, the mandrel is assembled, a primary winding 112*a* is wound thereon, and the corresponding secondary winding 112*b* is wound over the primary winding 112*a*. The mandrel is subsequently disassembled to permit removal of the completed phase winding 112 therefrom. This process is repeated until the phase windings 112 for each of the winding legs 102, 104, 106 have been completed.

The winding legs 102, 104, 106 are fixedly coupled to the lower yoke 110 (the resulting assembly is commonly referred to as an "E-core"). Each completed phase winding 112 is subsequently placed over a respective winding leg 102, 104, 106, and may be secured to the winding leg 102, 104, 106 by a suitable means such as brackets 107. The upper yoke 108 is then fixedly coupled to the winding legs 102, 104, 106.

An alternative conventional manufacturing process for the transformer 100 comprises placing the winding legs 102, 104, 106 in a suitable winding machine individually, winding the primary windings 112*a* directly on the winding legs 102, 104, 106, and then winding the secondary winding 112*b* on each primary winding 112*a*. The upper and lower yokes 108, 110 are subsequently coupled to the winding legs 102, 104, 106. The presence of the phase windings 112 on the winding legs 102, 104, 106 usually necessitates the use of a suitable fixture to support the winding legs 102, 104, 106 as the upper and lower yokes 108, 110 are joined thereto.

Each of the above-described activities adds to the time and expense associated with manufacturing the transformer 100. For example, the use of a mandrel to form the phase windings 112 requires the assembly and disassembly of the mandrel each time a phase winding 112 is formed. Winding the phase windings 112 directly on the winding legs 102, 104, 106 in the alternative process requires that each winding leg 102, 104, 106 be installed in and removed from a winding machine, and then placed in a support fixture so that the upper and lower yokes 108, 110 can be joined thereto. In addition, the stresses imposed on the winding legs 102, 104, 106 require that the laminae 120 that form the winding legs 102, 104, 106 be bound together more strongly than would otherwise be required.

Both of the above-described processes for assembling the transformer 100 require that the phase windings 112 be installed on the winding legs 102, 104, 106 prior to final assembly of the magnetic core 101. This requirement represents a disadvantage because manufacture of the magnetic core 101 and final assembly of the transformer 100 often take place at different locations. Shipping the magnetic core 101 from its place of manufacture to the final assembly location usually necessitates installing the upper yoke 108 on the assembled E-core on a temporary basis. The upper yoke 108 is subsequently removed from the E-core to facilitate installation of the phase windings 112. The upper yoke 108 is coupled to the winding legs 102, 104, 106 on a final basis after the phase windings 112 have been installed.

Neither of the above-described manufacturing processes are particularly advantageous when used in connection with a transformer having windings formed from insulated conductive cabling. In particular, insulated conductive cabling can be wound into a phase winding such as the phase winding 112 without a need to integrate a separate insulative material into the winding, as noted previously. Neither of the above-described processes offer manufacturing advantages that stem from this feature.

A need therefore exists for a process for manufacturing an electrical-power transformer that requires fewer activities and less equipment than a conventional assembly process. A manufacturing process that permits final assembly of the core without the corresponding phase windings installed thereon is desirable. A manufacturing process that provides advantages associated with the unique manufacturing characteristics of phase windings formed from insulated conductive cabling is also desirable.

SUMMARY OF THE INVENTION

A presently-preferred process for manufacturing an electrical-power transformer comprises stacking a plurality of laminae to form a first, a second, and a third winding leg and an upper and a lower yoke, and fixedly coupling the first, second, and third winding legs to the lower yoke. The presently-preferred process also comprises winding a first length of insulated conductive cabling on the first winding leg to form a first phase winding, winding a second length of the insulated conductive cabling on the second winding leg to form a second phase winding, and winding a third length of the insulated conductive cabling on the third winding leg to form a third phase winding after coupling the first, second, and third winding legs to the lower yoke. The presently-preferred process further comprises fixedly coupling the first, second, and third winding legs to the upper yoke after forming the first, second, and third phase windings.

Another presently-preferred a process for manufacturing an electrical-power transformer comprises stacking a plurality of laminae to form a first, a second, and a third winding leg and an upper and a lower yoke. The presently-preferred process also comprises fixedly coupling the first, second, and third winding legs to the lower yoke, and fixedly coupling the first, second, and third winding legs to the upper yoke. The presently-preferred process further comprises winding a first length of insulated conductive cabling on the first winding leg to form a first phase winding, winding a second length of the insulated conductive cabling on the second winding leg to form a second phase winding, and winding a third length of the insulated conductive cabling on the third winding leg to form a third phase winding after coupling the first, second, and third winding legs to the upper and lower yokes.

A presently-preferred process for manufacturing a magnetic-induction device comprises forming a plurality of laminae from a sheet of magnetic material, stacking the plurality of laminae to form a winding leg, a first yoke, and a second yoke, and fixedly coupling a first end of the winding leg to the first yoke. The presently-preferred process also comprises winding a length of insulated conductive cabling on the winding leg to form a phase winding after fixedly coupling the winding leg to the first yoke, and fixedly coupling a second end of the winding leg to the second yoke after forming the phase winding.

Another presently-preferred process for manufacturing a magnetic-induction device comprises forming a plurality of laminae from a sheet of magnetic material, stacking the plurality of laminae to form a winding leg, a first yoke, and a second yoke, and fixedly coupling a first end of the winding leg to the first yoke. The presently-preferred process also comprises fixedly coupling a second end of the winding leg to the second yoke, and winding a length of insulated conductive cabling on the winding leg to form a phase winding after fixedly coupling the winding leg to the first and second yokes.

Another presently-preferred process for manufacturing an electrical-power transformer comprises assembling an E-core. The presently-preferred process also comprises winding a first length of insulated conductive cabling on a first winding leg of the E-core to form a first phase winding, winding a second length of the insulated conductive cabling on a second winding leg of the E-core to form a second phase winding, and winding a third length of the insulated conductive cabling on a third winding leg of the E-core to form a third phase winding after assembling the E-core. The presently-preferred process further comprises fixedly coupling an upper yoke to the E-core after forming the first, second, and third phase windings.

Another presently-preferred process for manufacturing an electrical-power transformer comprises assembling a magnetic core. The presently-preferred process also comprises winding a first length of insulated conductive cabling on a first winding leg of the magnetic core to form a first phase winding, winding a second length of the insulated conductive cabling on a second winding leg of the magnetic core to form a second phase winding, and winding a third length of the insulated conductive cabling on a third winding leg of the magnetic core to form a third phase winding after assembling the magnetic core.

BRIEF DESCRIPTION OF THE DRAWINGS

The foregoing summary, as well as the following detailed description of presently-preferred processes, is better understood when read in conjunction with the appended drawings. For the purpose of illustrating the invention, the drawings depict a distribution transformer that is capable of being manufactured in accordance with the presently-preferred process. The invention is not limited, however, to use with the specific transformer disclosed in the drawings. In the drawings.

DESCRIPTION OF THE PREFERRED EMBODIMENTS

Figure 1:
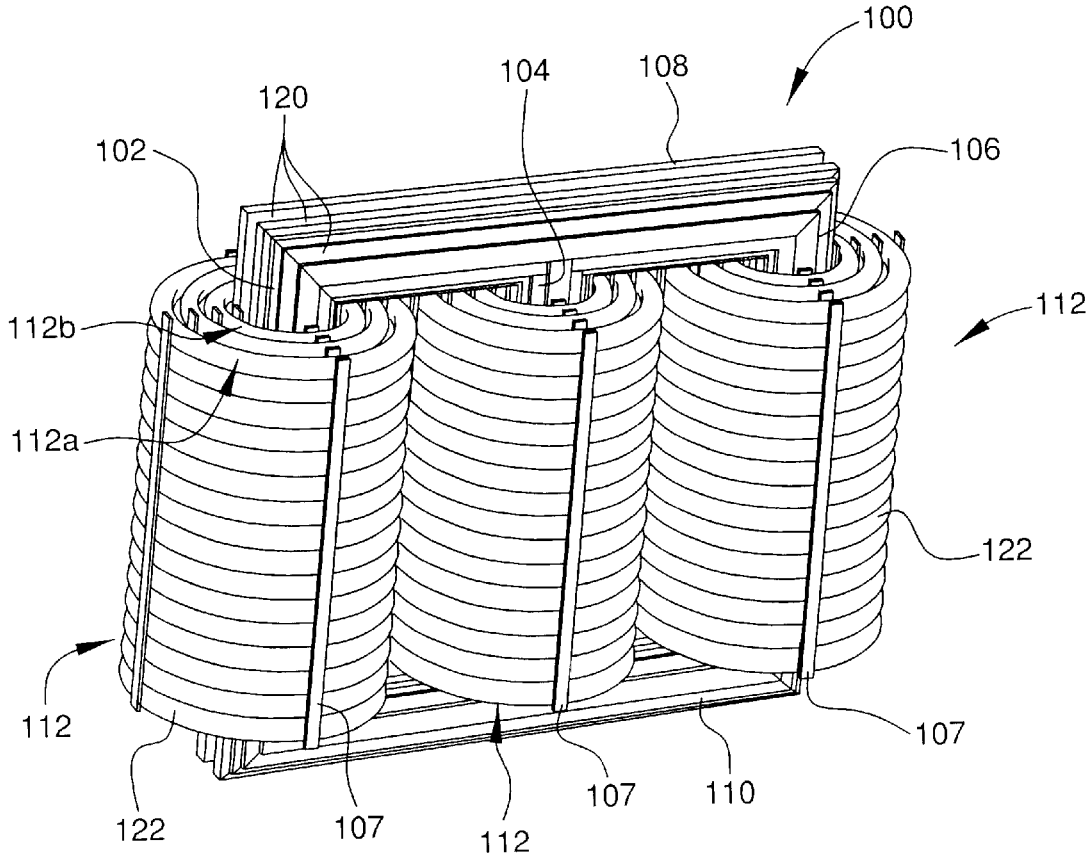
FIG. 1 is a diagrammatic illustration of a distribution transformer that can be manufactured in accordance with the presently-preferred process.
Figure 2:
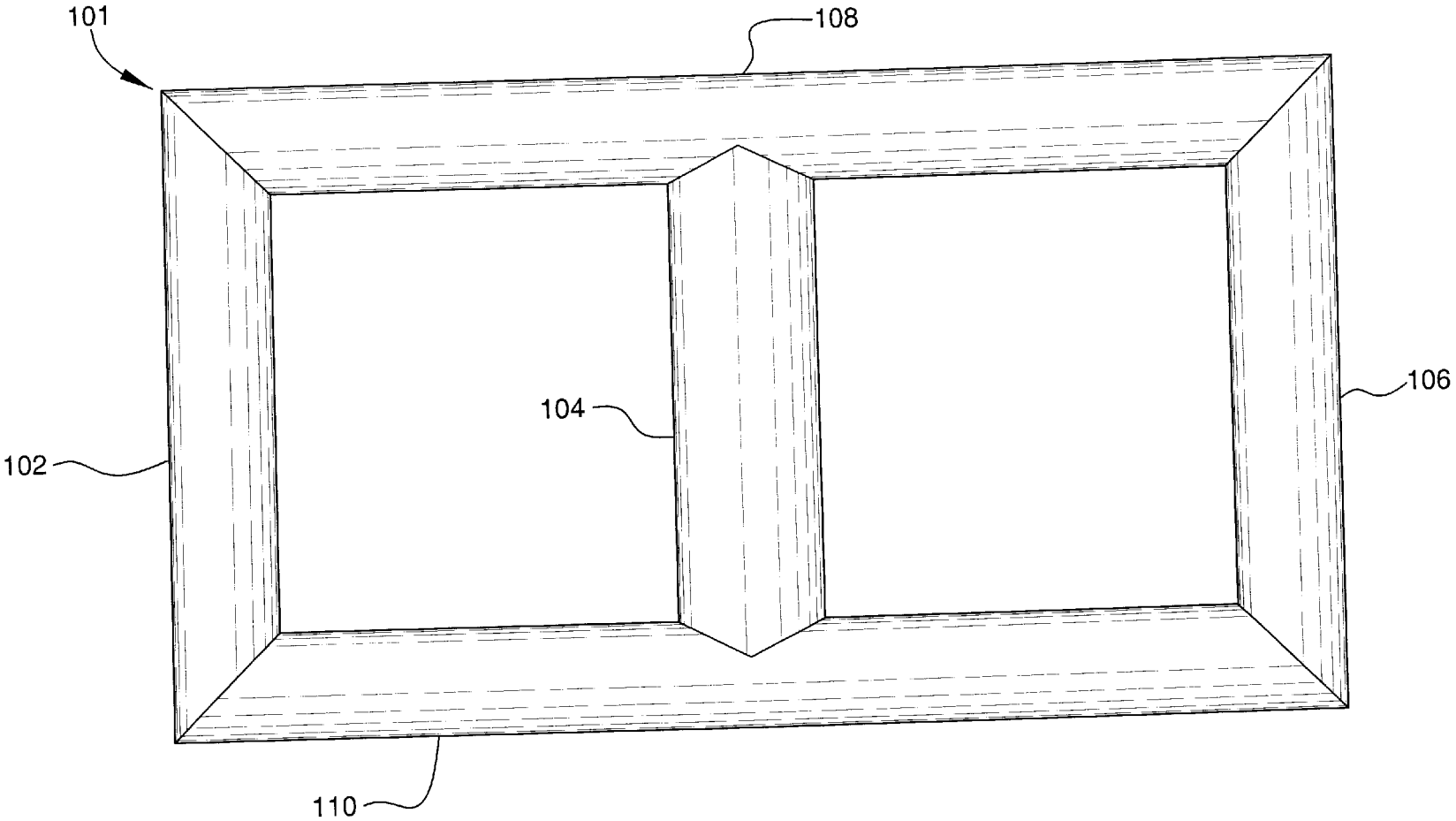
FIG. 2 is a side view of a fully assembled core of the distribution transformer shown in FIG. 1.

The present invention relates to the manufacture of a magnetic induction device such as an electrical-power transformer. A presently-preferred process is described in connection with a dry, three-phase, three-legged, core-type distribution transformer. This particular type of electrical-power transformer is described for exemplary purposes only; the presently-preferred process is applicable to virtually any transformer, including single-phase transformers, oil-filled transformers, and transformers having more or less than three legs. Furthermore, the presently-preferred process is applicable to magnetic-induction devices other than distribution transformers.

The previously-described transformer 100 can be manufactured in accordance with the presently-preferred process. The presently-preferred process is thus described herein in connection with the transformer 100, for convenience. Significant details relating to the transformer 100 are repeated below, for clarity.

The transformer 100, and individual components thereof, are depicted in FIGS. 1–6. Details of the transformer 100 in addition those shown in the figures, e.g., an outer casing, are not necessary for an understanding of the presently-preferred process, and therefore are not included in the figures.

The transformer 100, as noted previously, comprises a magnetic core 101. The magnetic core 101 comprises a first winding leg 102, a second winding leg 104, and a third winding leg 106. The transformer 100 also comprises an upper yoke 108 and a lower yoke 110. The winding legs 102, 104, 106 and the upper and lower yokes 108, 110 each comprise a plurality of laminae 120, as described in detail below. (It should be noted that some of the laminae 120 are not depicted in FIGS. 3, 5, and 6, for clarity.)

Opposing ends of the winding legs 102, 104, 106 are fixedly coupled to the upper and lower yokes 108, 110 using a suitable means such as adhesive. A cylindrical phase winding 112 is positioned on each of the winding legs 102, 104, 106. Each phase winding 112 comprises a low-voltage primary winding 112*a* and a concentric, high-voltage secondary winding 112*b* located radially outward of the primary winding 112*a*. The primary and secondary windings 112*a*, 112*b* are each formed by multiple layers, or coils, of insulated conductive cabling 122 connected in series. Each layer is formed by a plurality of turns of the cabling 122 connected in series.

Figure 4:
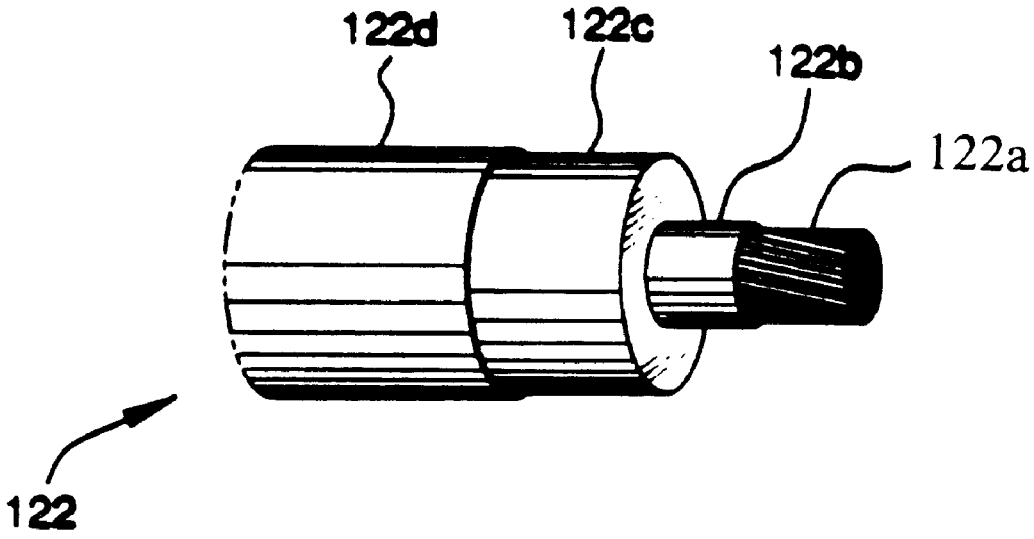
FIG. 4 is a perspective view of a portion of an insulated conductive cable used to form phase windings of the distribution transformer shown in FIG. 1.

The insulated conductive cabling 122 is of the type disclosed in PCT application serial no. PCT/SE/9700875. The insulated conductive cabling 122 comprises an inner conductor 122*a* surrounded by a concentric first layer of semi-conductor material 122*b*, as shown in FIG. 4. The first layer of semi-conductor material 122*b* preferably has a resistivity of approximately 1 Ω-cm to approximately 100 kΩ-cm, and a resistance per unit length of approximately 50 Ω/m to approximately 50 MΩ/m.

The first layer of semi-conductor material 122*b* is surrounded by a concentric layer of solid insulative material 122*c*. The layer of solid insulative material 122*c* is surrounded by a concentric second layer of semi-conductor material 122*c* that forms the outermost portion of the conductive cabling 122. The second layer of semi-conductor material 122*d* preferably has a resistivity of approximately $10^{-6}$ Ω-cm to approximately 100 kΩ-cm, and a resistance per unit length of approximately 50 μΩ/m to approximately 5 MΩ/m. (It should be noted that specific details concerning the insulated conductive cabling 122 are presented for exemplary purposes only; the presently-preferred process can be used in connection with insulated conductive cabling having electrical properties and a physical configuration substantially different from those of the insulated conductive cabling 122.)

A first presently-preferred process for manufacturing the transformer 100 is as follows. The winding legs 102, 104, 106 and the upper and lower yokes 108, 110 are each formed from a plurality of laminae 120, as noted previously. The laminae 120 are cut, punched, or sheared from a sheet of suitable magnetic material such as textured silicon steel or an amorphous alloy. Each lamina 120 is formed with a size and shape corresponding to the constituent element of the magnetic core 101 in which that particular lamina 120 will be used, e.g., the upper yoke 108. The laminae 120 are subsequently stacked to a predetermined depth and bound using a suitable means such as adhesive, thereby forming the winding legs 102, 104, 106 and the upper and lower yokes 108, 110.

Figure 3:
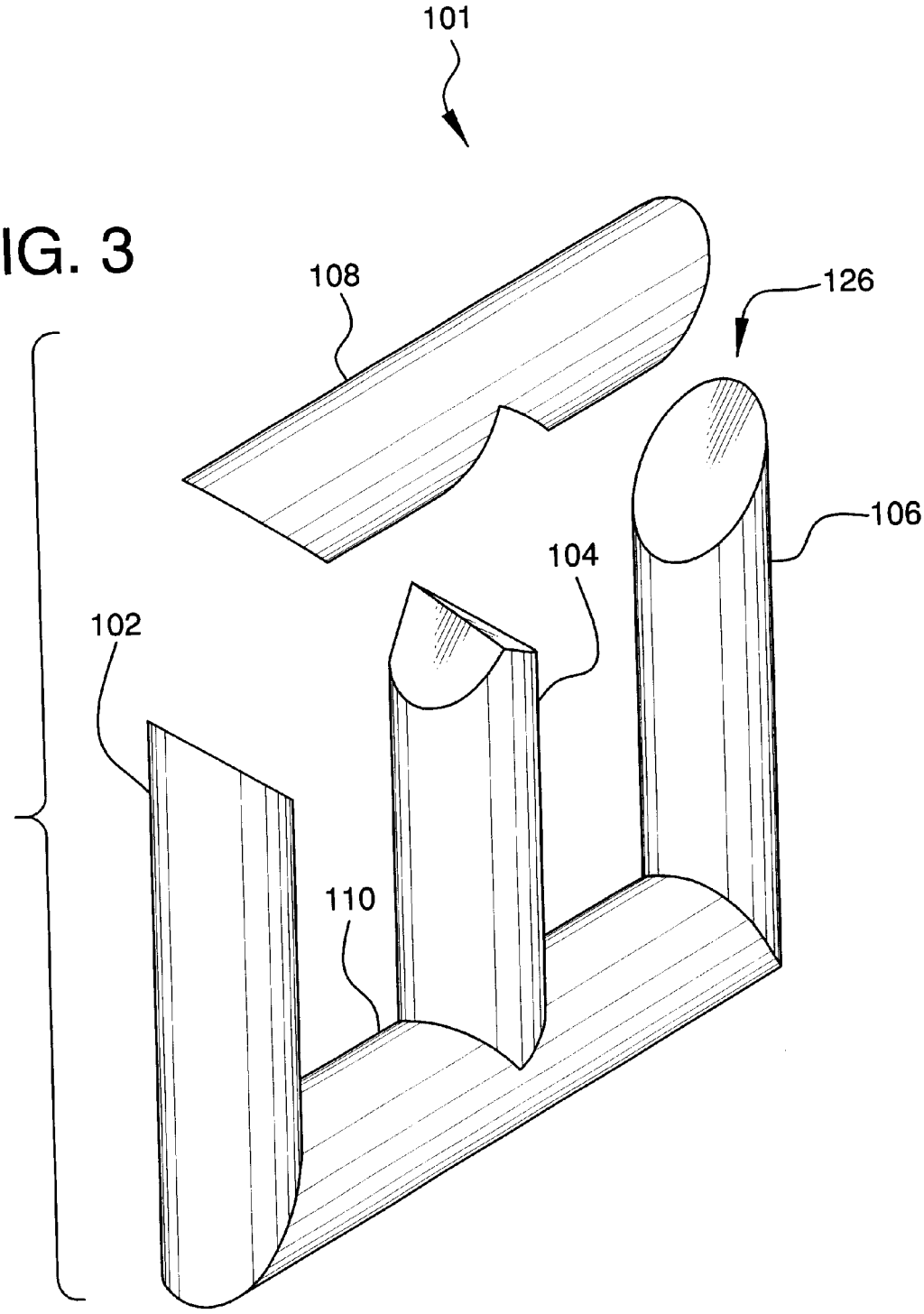
FIG. 3 is a partially exploded perspective view of the core shown in FIG. 2.
Figure 5:
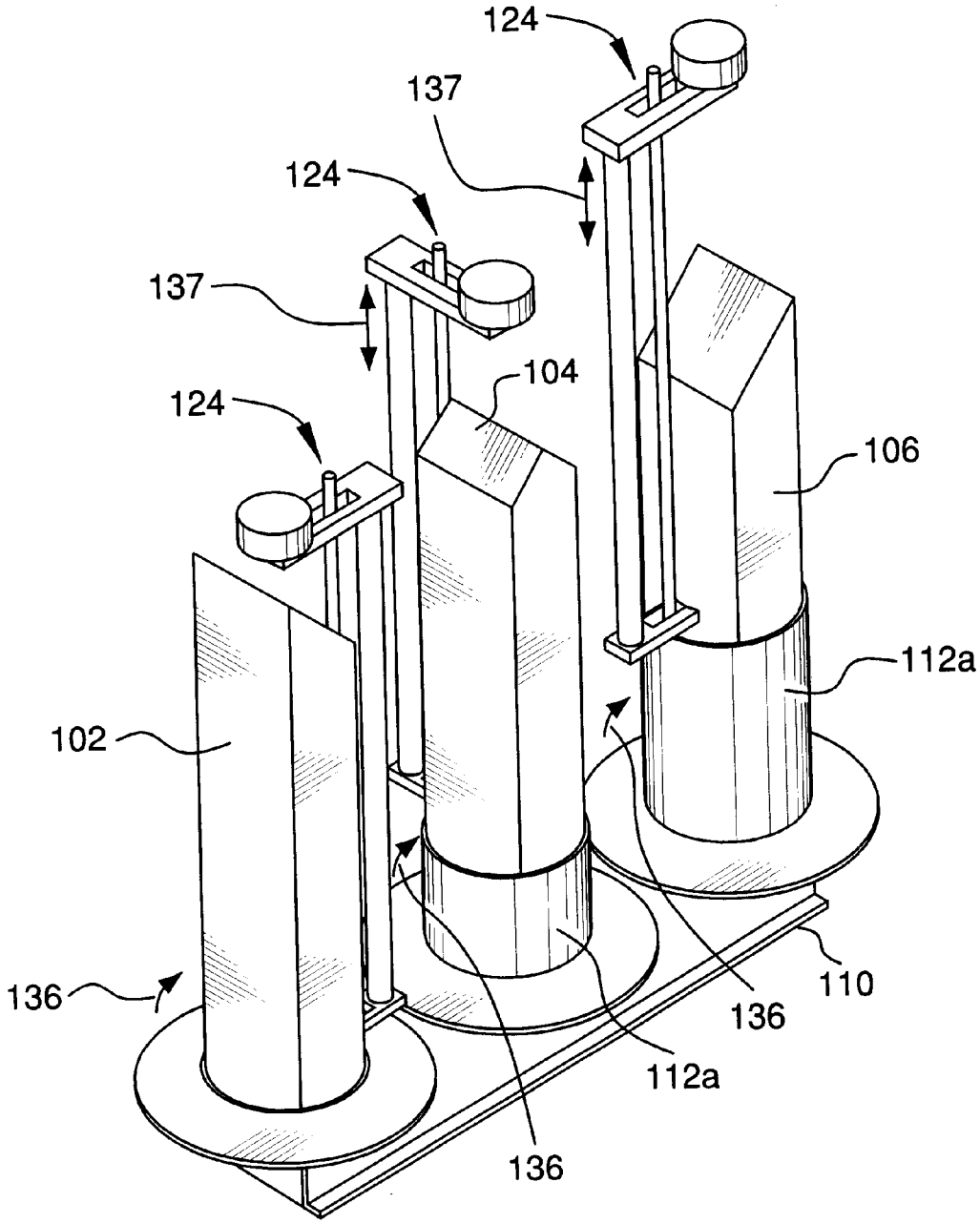
FIG. 5 is a perspective view of the core shown in FIGS. 2 and 1 in a partially-assembled condition, with phase windings being wound thereon by a first type of winding guide.

The winding legs 102, 104, 106 are fixedly coupled to the lower yoke 110 to form an E-core 126 (see FIGS. 3 and 5). More particularly, a lower end of the winding leg 102 is fixedly coupled to a first end of the lower yoke 110 using a suitable means such as adhesive. A lower end of the winding leg 106 is fixedly coupled to a second end of the lower yoke 110, and a lower end of the winding leg 104 is fixedly coupled to the approximate mid-point of the lower yoke 110 in a likewise manner.

(It should be noted that directional terms such as "upper" and "lower" are used with reference to the component orientations depicted in FIG. 1; these terms are utilized for illustrative purposes only and, unless expressly stated otherwise, are not intended to limit the scope of the appended claims.)

The phase windings 112 are subsequently wound on the E-core 126 while the E-core 126 is in a vertical position, i.e., while the E-core 126 is in the position depicted in FIGS. 3 and 5. More particularly, the insulated conductive cabling 122 is wound on the winding legs 102, 104, 106 using one or more suitable winding guides 124 (the winding guides 124 are depicted in diagrammatical form in FIG. 5). Each winding guide 124 is adapted to draw the insulated conductive cabling 122 from a respective spool located in a reservoir (not shown) above the winding guide 124. Each winding guide 124 is also adapted to rotate around a respective winding leg 102, 104, 106 as the winding guide 124 translates linearly in the upward or downward directions. (The direction of rotation, and the direction of linear travel of the winding guides 124 are denoted respectively by the arrows 136, 137 in FIG. 5). The noted motion of the winding guides 124 winds the insulated conductive cabling 122 around the winding leg 102, 104, 106 in a series of adjacent turns.

The winding guide 124 is adapted to reverse direction upon reaching the upper or lower limits of its linear travel. More particularly, the winding guide 124 begins translating upwardly (while continuing its rotational motion) upon reaching the lower limit of its travel. Similarly, the winding guide 124 begins translating downwardly upon reaching the upper limit of its travel. This motion forms adjacent layers of the insulated conductive cabling 122 on the winding leg 102, 104, 106, and is repeated until a predetermined number of layers have been formed, i.e., until a primary winding 112*a* has been wound around the winding legs 102, 104, 106. The insulated conductive cabling 122 is then cut to form a terminal on the primary winding 112*a*. A secondary winding 112*b* is subsequently wound over the primary winding 112*a* using the above-described winding process.

The above-described winding process requires the use of three winding guides 124 to form all of the phase windings 112 on a simultaneous basis (the phase windings 112 may alternatively be formed on a individual basis). For example, FIG. 5 depicts the winding leg 102 at the start of the winding process. FIG. 5 also depicts the winding leg 104 with approximately one-third of the first layer of the primary winding 112*a* wound thereon; the winding leg 106 is depicted with approximately one-half of the first layer of the primary winding 112*a* wound thereon.

Forming the phase windings 112 on a simultaneous basis requires synchronization of the winding guides 124 to avoid interference between the winding guides 124 as the winding guides 124 translate upwardly and downwardly. (It should be noted that specific details relating to the winding guides 124 are presented for illustrative purposes only; the above-described winding process can be performed using any suitable winding guide.)

The top yoke 108 is fixedly coupled to the E-core 126, i.e., to the winding legs 102, 104, 106, after the phase windings 112 have been wound. More particularly, an upper end of the winding leg 102 is fixedly coupled to a first end of the upper yoke 108 using a suitable means such as adhesive. An upper end of the winding leg 106 is fixedly coupled to a second end of the upper yoke 108, and an upper end of the winding leg 104 is fixedly coupled to the approximate mid-point of the upper yoke 108 in a likewise manner.

An alternative presently-preferred process for manufacturing the transformer 100 is as follows. The laminae 120 are formed and stacked in the above-described manner to form the constituent elements of the magnetic core 101. The upper and lower yokes 108, 110 are fixedly coupled to the winding legs 102, 104, 106 to form the completed magnetic core 101. More particularly, a lower end of the winding leg 102 is fixedly coupled to a first end of the lower yoke 110 using a suitable means such as adhesive. A lower end of the winding leg 106 is fixedly coupled to a second end of the lower yoke 110, and a lower end of the winding leg 104 is fixedly coupled to the approximate mid-point of the lower yoke 110 in a likewise manner.

An upper end of the winding leg 102 is then fixedly coupled to a first end of the upper yoke 108 using a suitable means such as adhesive. An upper end of the winding leg 106 is fixedly coupled to a second end of the upper yoke 108, and an upper end of the winding leg 104 is fixedly coupled to the approximate mid-point of the upper yoke 108 in a likewise manner.

Figure 6:
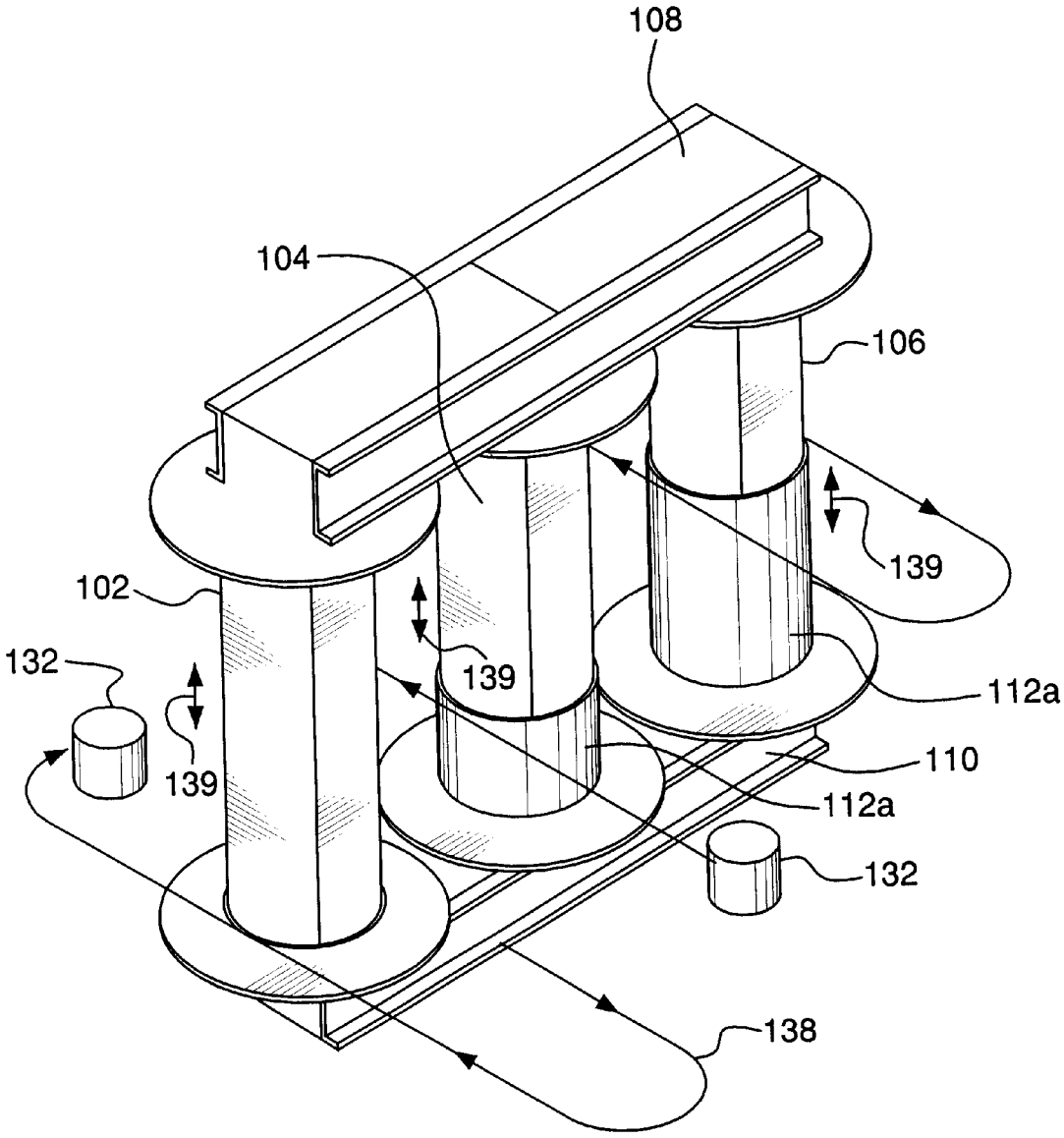
FIG. 6 is a perspective view of the core shown in FIGS. 2 and 3, with phase windings being wound thereon by a second type of winding guide.

The phase windings 112 are subsequently wound on the assembled magnetic core 101 while the magnetic core 101 is in a vertical position, i.e., while the magnetic core 101 is in the position depicted in FIG. 6. More particularly, the insulated conductive cabling 122 is wound on the winding legs 102, 104, 106 using one or more suitable winding guides 132 (see FIG. 6). (It should be noted that the winding guides 132 are depicted in diagrammatical form in FIG. 6; specific details of a winding guide suitable for use with the presently-preferred method are disclosed in U.S. Pat. No. 3,174,699, which is incorporated herein by reference in its entirety.)

Operational details relating to the winding guides 132 are as follows. A length of the insulated conductive cabling 122 sufficient to form one of the primary windings 112*a* is placed in each of the winding guides 132. The winding guides 132 each rotate around a respective winding leg 102, 104, 106 while translating linearly, in the upward or downward directions (the direction of rotation, and the direction of linear travel of the winding guides 132 are denoted respectively by the arrows 138, 139 in FIG. 6). This motion draws the insulated conductive cabling 122 from the winding guide 132, and winds the insulated to conductive cabling 122 around the corresponding winding leg 102, 104, 106 in a series of adjacent turns.

The winding guide 132 is adapted to reverse its direction upon reaching the upper or lower limits of its linear travel. More particularly, the winding guide 132 begins translating upwardly (while continuing its rotational motion) upon reaching the lower limit of its travel. Similarly, the winding guide 132 begins translating downwardly upon reaching the upper limit of its travel. This motion forms adjacent layers of the insulated conductive cabling 122 on the winding legs 102, 104, 106, and is repeated until a predetermined number of layers have been formed, i.e., until a primary winding 112*a* has been wound around the winding leg 102, 104, 106. A secondary winding 112*b* is subsequently wound over the primary winding 112*a* in a likewise manner.

The winding process described above uses three of the winding guides 132 to form all of the phase windings 112 on a simultaneous basis. For example, FIG. 6 depicts the winding leg 102 at the start of the winding process. FIG. 6 also depicts the winding leg 104 with approximately one-third of the first layer of the primary winding 112*a* wound thereon; the winding leg 106 is depicted with approximately one-half of the first layer of the primary winding 112*a* wound thereon. Forming the phase windings 112 in this manner is only possible where the winding legs 102, 104, 106 are spaced apart sufficiently to prevent interference between adjacent winding guides 132. (It should be noted that specific details relating to the winding guides 132 are presented for illustrative purposes only; the above-described winding process can be performed using any suitable winding guide.)

The presently-preferred processes for manufacturing an electrical-power transformer provides substantial advantages in relation to conventional processes. For example, winding the phase windings 112 directly on the winding legs 102, 104, 106 eliminates the need for mandrels during the manufacturing process. Hence, the expenses associated with purchasing mandrels, and the activities associated with assembling and disassembling the mandrels before and after each phase winding 12 is formed, can be eliminated through the use of the presently-preferred processes.

Special fixtures are not needed to support the winding legs 102, 104, 106 and the corresponding phase windings 112 during the presently-preferred processes because the phase windings 112 are placed on the winding legs 102, 104, 106 after the E-core 126 or the entire magnetic core 101 have been assembled. This feature also negates the need for a winding machine to form the phase windings 112, thereby eliminating the time and expense associated with the use thereof. Eliminating the use of a winding machine also negates the need to bind the laminae 120 within the winding legs 102, 104, 106 more strongly than would otherwise be required to withstand the stresses imposed by the winding machine.

The presently-preferred manufacturing processes permit the phase windings 112 to be wound on a fully-assembled core, and thereby provide additional advantages. For example, the magnetic core 101 can be assembled on a final basis at its place of manufacture, and then shipped to another location for final assembly of the transformer 100. In other words, the upper yoke 108 can be placed on the E-core 126 at a first location, and the phase windings 112 can subsequently be placed on the magnetic core 101 at another location without removing the upper yoke 108. This feature is advantageous because, as previously noted, cores such as the magnetic core 101 are often manufactured at a location that differs from the location at which the transformer 100 is assembled.

Both of the presently-preferred processes are particularly well-suited for use with insulated conductive cabling such as the insulated conductive cabling 122. More particularly, the insulated conductive cabling 122 can be formed into the phase windings 112 without a need to place additional insulative material between the turns and layers of the phase windings 112, as noted previously. Hence, the phase windings 112 can be formed using a minimal amount of relatively simple, compact equipment such as the winding guides 124, 132; equipment that would otherwise be required to place additional insulative material in the phase windings 112 is not needed. In other words, the insulated conductive cabling 122 is particularly well suited for being wound directly onto the partially or fully assembled magnetic core 101 because the insulated conductive cabling 122 can be wound into the phase windings 112 using only the winding guides 124, 132.

In addition, the primary and secondary windings 112*a*, 112*b* can be wound on a substantially continuous basis because additional insulative material does not have to be placed between adjacent turns and adjacent layers of the insulated conductive cabling 122. In other words, the winding process does not have to be interrupted to facilitate the placement of additional insulative material within the phase windings 112. The winding guides 124, 132 are particularly well suited for winding operations conducted on a continuous basis. Hence, the winding guides 124, 132 can form the phase windings 112 in a minimal amount of time when used in conjunction with the insulated conductive cabling 122.

It is to be understood that even though numerous characteristics and advantages of the present invention have been set forth in the foregoing description, together with specific details of a presently-preferred processes, the disclosure is illustrative only, and changes may be made in detail, especially in matters of shape, size, and arrangement of the parts described herein, within the principles of the invention to the full extent indicated by the broad general meaning of the terms in which the appended claims are expressed.

What is claimed is:

1. A process for manufacturing an electrical-power transformer, comprising:

stacking a plurality of laminae to form a first, a second, and a third winding leg and an upper and a lower yoke;

fixedly coupling the first, second, and third winding legs to the lower yoke;

winding a first length of insulated conductive cabling on the first winding leg to form a first phase winding, winding a second length of the insulated conductive cabling on the second winding leg to form a second phase winding, and winding a third length of the insulated conductive cabling on the third winding leg to form a third phase winding after coupling the first, second, and third winding legs to the lower yoke; and fixedly coupling the first, second, and third winding legs to the upper yoke after forming the first, second, and third phase windings.

2. The process of claim 1, wherein stacking a plurality of laminae to form a first, a second, and a third winding leg and an upper and a lower yoke comprises stacking the plurality of laminae to a predetermined depth and binding the laminae.

3. The process of claim 1, wherein:

winding a first length of insulated conductive cabling on the first winding leg to form a first phase winding comprises winding a first portion of the first length of insulated conductive cabling on the first winding leg to form a first primary winding, and winding a second portion of the first length of insulated conductive cabling over the first primary winding to form a first secondary winding;

winding a second length of insulated conductive cabling on the second winding leg to form a second phase winding comprises winding a first portion of the second length of insulated conductive cabling on the second winding leg to form a second primary winding, and winding a second portion of the second length of insulated conductive cabling over the second primary winding to form a second secondary winding; and winding a third length of insulated conductive cabling on the third winding leg to form a third phase winding comprises winding a first portion of the third length of insulated conductive cabling on the third winding leg to form a third primary winding, and winding a second portion of the third length of insulated conductive cabling over the third primary winding to form a third secondary winding.

4. The process of claim 1, wherein fixedly coupling the first, second, and third winding legs to the lower yoke comprises:

fixedly coupling a first end of the first winding leg to a first end of the lower yoke;

fixedly coupling a first end of the third winding leg to a second end of the lower yoke; and fixedly coupling a first end of the second winding leg to an approximate mid-point of the lower yoke.

5. The process of claim 4, wherein fixedly coupling the first, second, and third winding legs to the upper yoke comprises:

fixedly coupling a second end of the first winding leg to a first end of the upper yoke;

fixedly coupling a second end of the third winding leg to a second end of the upper yoke; and fixedly coupling a second end of the second winding leg to an approximate mid-point of the upper yoke.

6. The process of claim 1, further comprising forming the plurality of laminae from a sheet of magnetic material.

7. The process of claim 1, wherein:

winding a first length of insulated conductive cabling on the first winding leg to form a first phase winding comprises winding a first portion of the first length of insulated conductive cabling into a series of adjacent turns to form a first layer of the insulated conductive cabling on the first winding leg, and then winding a second portion of the first length of insulated conductive cabling into a second series of adjacent turns located over the first series of adjacent turns to form a second layer of the insulated conductive cabling on the first winding leg;

winding a second length of insulated conductive cabling on the second winding leg to form a second phase winding comprises winding a first portion of the second length of insulated conductive cabling into a first series of adjacent turns to form a first layer of the insulated conductive cabling on the second winding leg, and then winding a second portion of the second length of insulated conductive cabling into a second series of adjacent turns located over the first series of adjacent turns to form a second layer of the insulated conductive cabling on the second winding leg; and winding a third length of insulated conductive cabling on the third winding leg to form a third phase winding comprises winding a first portion of the third length of insulated conductive cabling into a first series of adjacent turns to form a first layer of the insulated conductive cabling on the third winding leg, and then winding a second portion of the third length of insulated conductive cabling into a second series of adjacent turns located over the first series of adjacent turns to form a second layer of the insulated conductive cabling on the third winding leg.

8. A process for manufacturing an electrical-power transformer, comprising:

stacking a plurality of laminae to form a first, a second, and a third winding leg and an upper and a lower yoke;

fixedly coupling the first, second, and third winding legs to the lower yoke;

fixedly coupling the first, second, and third winding legs to the upper yoke; and winding a first length of insulated conductive cabling on the first winding leg to form a first phase winding, winding a second length of the insulated conductive cabling on the second winding leg to form a second phase winding, and winding a third length of the insulated conductive cabling on the third winding leg to form a third phase winding after coupling the first, second, and third winding legs to the upper and lower yokes, wherein the insulated conductive cabling comprises a conductor, a first layer of semi-conductor material surrounding the conductor, a layer of electrically-insulating material surrounding the first layer of semi-conductor material, and a second layer of semi-conductor material surrounding the layer of electrically-insulating material.

9. The process of claim 8, wherein stacking a plurality of laminae to form a first, a second, and a third winding leg and an upper and a lower yoke comprises stacking the plurality of laminae to a predetermined depth and binding the laminae.

10. The process of claim 8, wherein:

winding a first length of insulated conductive cabling on the first winding leg to form a first phase winding comprises winding a first portion of the first length of insulated conductive cabling on the first winding leg to form a first primary winding, and winding a second portion of the first length of insulated conductive cabling over the first primary winding to form a first secondary winding;

winding a second length of insulated conductive cabling on the second winding leg to form a second phase winding comprises winding a first portion of the second length of insulated conductive cabling on the second winding leg to form a second primary winding, and winding a second portion of the second length of insulated conductive cabling over the second primary winding to form a second secondary winding; and winding a third length of insulated conductive cabling on the third winding leg to form a third phase winding comprises winding a first portion of the third length of insulated conductive cabling on the third winding leg to form a third primary winding, and winding a second portion of the third length of insulated conductive cabling over the third primary winding to form a third secondary winding.

11. The process of claim 8, wherein fixedly coupling the first, second, and third winding legs to the lower yoke comprises:

fixedly coupling a first end of the first winding leg to a first end of the lower yoke;

fixedly coupling a first end of the third winding leg to a second end of the lower yoke; and fixedly coupling a first end of the second winding leg to an approximate mid-point of the lower yoke.

12. The process of claim 11, wherein fixedly coupling the first, second, and third winding legs to the upper yoke comprises:

fixedly coupling a second end of the first winding leg to a first end of the upper yoke;

fixedly coupling a second end of the third winding leg to a second end of the upper yoke; and fixedly coupling a second end of the second winding leg to an approximate mid-point of the upper yoke.

13. The process of claim 8, further comprising forming the plurality of laminae from a sheet of magnetic material.

14. The process of claim 8 wherein:

winding a first length of insulated conductive cabling on the first winding leg to form a first phase winding comprises winding a first portion of the first length of insulated conductive cabling into a series of adjacent turns to form a first layer of the insulated conductive cabling on the first winding leg, and then winding a second portion of the first length of insulated conductive cabling into a second series of adjacent turns located over the first series of adjacent turns to form a second layer of the insulated conductive cabling on the first winding leg;

winding a second length of insulated conductive cabling on the second winding leg to form a second phase winding comprises winding a first portion of the second length of insulated conductive cabling into a first series of adjacent turns to form a first layer of the insulated conductive cabling on the second winding leg, and then winding a second portion of the second length of insulated conductive cabling into a second series of adjacent turns located over the first series of adjacent turns to form a second layer of the insulated conductive cabling on the second winding leg; and winding a third length of insulated conductive cabling on the third winding leg to form a third phase winding comprises winding a first portion of the third length of insulated conductive cabling into a first series of adjacent turns to form a first layer of the insulated conductive cabling on the third winding leg, and then winding a second portion of the third length of insulated conductive cabling into a second series of adjacent turns located over the first series of adjacent turns to form a second layer of the insulated conductive cabling on the third winding leg.

15. A process for manufacturing a magnetic-induction device, comprising:

forming a plurality of laminae from a sheet of magnetic material;

stacking the plurality of laminae to form a winding leg, a first yoke, and a second yoke;

fixedly coupling a first end of the winding leg to the first yoke;

winding a length of insulated conductive cabling on the winding leg to form a phase winding after fixedly coupling the winding leg to the first yoke; and fixedly coupling a second end of the winding leg to the second yoke after forming the phase winding.

16. The process of claim 15, further comprising:

stacking the plurality of laminae to form a second and a third winding leg;

fixedly coupling a first end of the second winding leg to the first yoke;

fixedly coupling a first end of the third winding leg to the first yoke;

winding a second length of the insulated conductive cabling on the second winding leg to form a second phase winding after fixedly coupling the second winding leg to the first yoke;

winding a third length of the insulated conductive cabling on the third winding leg to form a third phase winding after fixedly coupling the third winding leg to the first yoke;

fixedly coupling a second end of the second winding leg to the second yoke after forming the second phase winding; and fixedly coupling a second end of the third winding leg to the second yoke after forming the third phase winding.

17. A process for manufacturing a magnetic-induction device, comprising:

forming a plurality of laminae from a sheet of magnetic material;

stacking the plurality of laminae to form a winding leg, a first yoke, and a second yoke;

fixedly coupling a first end of the winding leg to the first yoke;

fixedly coupling a second end of the winding leg to the second yoke; and winding a length of insulated conductive cabling on the winding leg to form a phase winding after fixedly coupling the winding leg to the first and second yokes, wherein the insulated conductive cabling comprises a conductor, a first layer of semi-conductor material surrounding the conductor, a layer of electrically-insulating material surrounding the first layer of semi-conductor material, and a second layer of semi-conductor material surrounding the layer of electrically-insulating material.

18. The process of claim 17, further comprising:

stacking the plurality of laminae to form a second and a third winding leg;

fixedly coupling a first end of the second winding leg to the first yoke;

fixedly coupling a first end of the third winding leg to the first yoke;

fixedly coupling a second end of the second winding leg to the second yoke;

fixedly coupling a second end of the third winding leg to the second yoke;

winding a second length of the insulated conductive cabling on the second winding leg to form a second phase winding after fixedly coupling the second winding leg to the first and second yokes; and winding a third length of the insulated conductive cabling on the third winding leg to form a third phase winding after fixedly coupling the third winding leg to the first and second yokes.

19. A process for manufacturing an electrical-power transformer, comprising:

assembling an E-core;

winding a first length of insulated conductive cabling on a first winding leg of the E-core to form a first phase winding, winding a second length of the insulated conductive cabling on a second winding leg of the E-core to form a second phase winding, and winding a third length of the insulated conductive cabling on a third winding leg of the E-core to form a third phase winding after assembling the E-core; and fixedly coupling an upper yoke to the E-core after forming the first, second, and third phase windings.

20. The process of claim 19, wherein assembling an E-core comprises:

fixedly coupling a first end of the first winding leg to a first end of a lower yoke;

fixedly coupling a first end of the third winding leg to a second end of the lower yoke; and fixedly coupling a first end of the second winding leg to an approximate mid-point of the lower yoke.

21. A process for manufacturing an electrical-power transformer, comprising:

assembling a magnetic core; and winding a first length of insulated conductive cabling on a first winding leg of the magnetic core to form a first phase winding, winding a second length of the insulated conductive cabling on a second winding leg of the magnetic core to form a second phase winding, and winding a third length of the insulated conductive cabling on a third winding leg of the magnetic core to form a third phase winding after assembling the magnetic core, wherein the insulated conductive cabling comprises a conductor, a first layer of semi-conductor material surrounding the conductor, a layer of electrically-insulating material surrounding the first layer of semi-conductor material, and a second layer of semi-conductor material surrounding the layer of electrically-insulating material.

22. The process of claim 21, wherein assembling a magnetic ore comprises:

fixedly coupling a first end of the first winding leg to a first end of a lower yoke;

fixedly coupling a first end of the third winding leg to a second end of the lower yoke;

fixedly coupling a first end of the second winding leg to an approximate mid-point of the lower yoke;

fixedly coupling a second end of the first winding leg to a first end of an upper yoke;

fixedly coupling a second end of the third winding leg to a second end of the upper yoke; and fixedly coupling a second end of the second winding leg to an approximate mid-point of the upper yoke.

23. A transformer manufactured in accordance with the process of claim 1.

24. A transformer manufactured in accordance with the process of claim 8.

* * * * *